US005826483A

United States Patent [19]

Koseki

[11] Patent Number: 5,826,483

[45] Date of Patent: Oct. 27, 1998

[54] HYDRAULIC HEAVY EQUIPMENT

[75] Inventor: Mitsuhiro Koseki, Tokyo, Japan

[73] Assignee: Kabushiki Kaisha F.F.C., Tokyo, Japan

[21] Appl. No.: 899,756

[22] Filed: Jul. 24, 1997

[30] Foreign Application Priority Data

Jul. 26, 1996 [JP] Japan ..... 8-197695
Nov. 21, 1996 [JP] Japan ..... 8-311019

[51] Int. Cl.[6] ..... F15B 13/16

[52] U.S. Cl. ..... 91/361; 91/392; 91/511

[58] Field of Search ..... 91/358 R, 361, 91/392, 508, 511, 513

[56] References Cited

U.S. PATENT DOCUMENTS 4,516,469 5/1985 Sato et al. ..... 91/513 X
4,773,302 9/1988 Mizota et al. ..... 91/361
4,863,337 9/1989 Ishiguro et al. ..... 91/361 X
5,189,940 3/1993 Hosseini et al. ..... 91/361
5,617,723 4/1997 Hosseini et al. ..... 91/361 X
5,701,793 12/1997 Gardner et al. ..... 91/361

*Primary Examiner*—Hoang Nguyen
*Attorney, Agent, or Firm*—Leydig, Voit & Mayer

[57] ABSTRACT

In hydraulic heavy equipment, a working device has a boom, an arm and a bucket. An operating device has the same link structure as in the working device. By operating the working device, control valves are operated and the working device functions in a similar manner to the operating device. The movement of the working device is transmitted, and the control valves are brought back to the neutral position. Therefore, the working device follows up the operating device, and functions in the same manner as the operating device.

17 Claims, 19 Drawing Sheets

HYDRAULIC HEAVY EQUIPMENT

BACKGROUND OF THE INVENTION

1. Field of the Invention

The present invention relates to hydraulic heavy equipment such as hydraulic excavators.

2. Description of the Related Art

In conventional hydraulic excavators, there are provided two operating levers for controlling an actuator for a working device These operating levers are each operable in four directions, i.e., in a total of eight directions. In a hydraulic excavator, the boom, arm, bucket and pivoting body pivot in two directions each, making a total of eight directions. The operating directions of the boom, arm, bucket and pivoting body correspond to the operating directions of the operating lever mentioned above.

However, in a conventional hydraulic excavator as described above, the operating directions of the boom, arm, bucket and pivoting body differ from those of the operating lever. A problem is therefore that great skill is required to intuitively comprehend the relationship between these operating and working directions and ensure smooth operation of the heavy equipment. Another problem is that considerable differences are caused in the progress of work by the personal ability of operators such as the degree of skill, thus exerting a large influence on the period of work as a whole.

SUMMARY OF THE INVENTION

The present invention was developed to solve the problems as described above, and in directed to providing hydraulic heavy equipment which permit smooth operation without requiring great skill.

To this end, according to one aspect of the present invention, there is provided hydraulic heavy equipment comprising: a heavy equipment body; a working device having a plurality of working side pivoting members pivotably connected to each other, mounted on the heavy equipment body; hydraulic cylinders which cause the working side pivoting members to pivot; a hydraulic circuit section for operating the hydraulic cylinders, the hydraulic circuit section having switching valves for switching over the operating direction of the hydraulic cylinders; an operating device having a plurality of operating side pivoting members which correspond to the working side pivoting members and are pivotably connected to each other; control valves for controlling the switching valves by being operated by the operating device; and transmitting means for transmitting pivoting of the working side pivoting members and bringing the control valves corresponding to the working side pivoting members back to a neutral state.

According to another aspect of the present invention, there is provided hydraulic heavy equipment comprising: a heavy equipment body; a working device having a plurality of working side pivoting members pivotably connected to each other, and mounted on the heavy equipment body; hydraulic cylinders causing the working side pivoting members; a hydraulic circuit section for operating the hydraulic cylinders, the hydraulic circuit section having switching valves for switching over the operating direction of the hydraulic cylinders; an operating device having a plurality of operating side pivoting members which correspond to the working side pivoting members and are pivotably connected to each other; control valves for controlling the switching valves; servo motors for operating the control valves; operating side sensors for detecting pivoting of the operating side pivoting members; working side sensors for detecting pivoting of the working side pivoting members; and a control section which receives input of a signal from the operating side sensors and the working side sensors, and controls the servo motors so as to ensure operation of the working side pivoting members in a manner similar to that of the operating side pivoting members.

DETAILED DESCRIPTION OF THE PREFERRED EMBODIMENTS

Now, embodiments of the present invention will be described below with reference to the drawings.

First Embodiment

Figure 1:
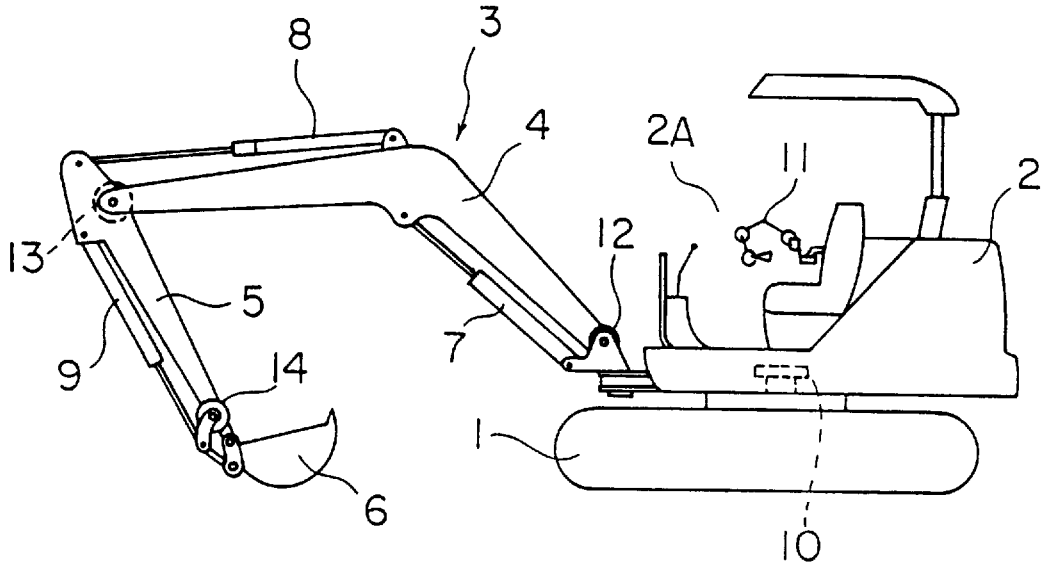
FIG. 1 is a schematic side view illustrating a hydraulic excavator of a first embodiment of the invention.

FIG. 1 is a schematic structural diagram illustrating a hydraulic excavator in a first embodiment of the invention. In FIG. 1, an upper pivoting body 2 having an operator's cab 2A is pivotably provided on a lower propulsion unit 1. A working device 3 is mounted on this upper pivoting body 2. This working device 3 has a boom 4 serving as a working side pivoting member connected pivotably to the upper pivoting body 2, an arm 5 serving as a working side pivoting member connected pivotably to this boom 4, and a bucket 6 serving as a working side pivoting member connected pivotably to this arm 5.

Further, a boom cylinder 7 is provided between the upper pivoting body 2, an arm cylinder 8, between the boom 4 and the arm 5, and a bucket cylinder 9, between the arm 5 and the bucket 6. Hydraulic cylinders are employed as these cylinders 7, 8 and 9. The upper pivoting body 2 is pivotable relative to the lower propulsion unit 1 under the effect of a pivoting motor 10 which is a hydraulic motor. In the operator's cab 2A, there is provided an operating device 11 comprised of a link mechanism formed by reducing in size the link mechanism of the working device 3 at an appropriate ratio.

A boom pulley 12 serving as a working side pulley pivoting integrally with the boom 4 around the pivoting axis of the boom 4 is fixed to the base of the boom 4. An arm pulley 13 serving as a working side pulley which pivots integrally with the arm 5 around the pivoting axis of the arm 5 is secured to the arm 5. A bucket pulley 14 serving as a working side pulley which pivots integrally with the bucket 6 is secured to part of the link mechanism for pivoting the bucket 6.

Figure 2:
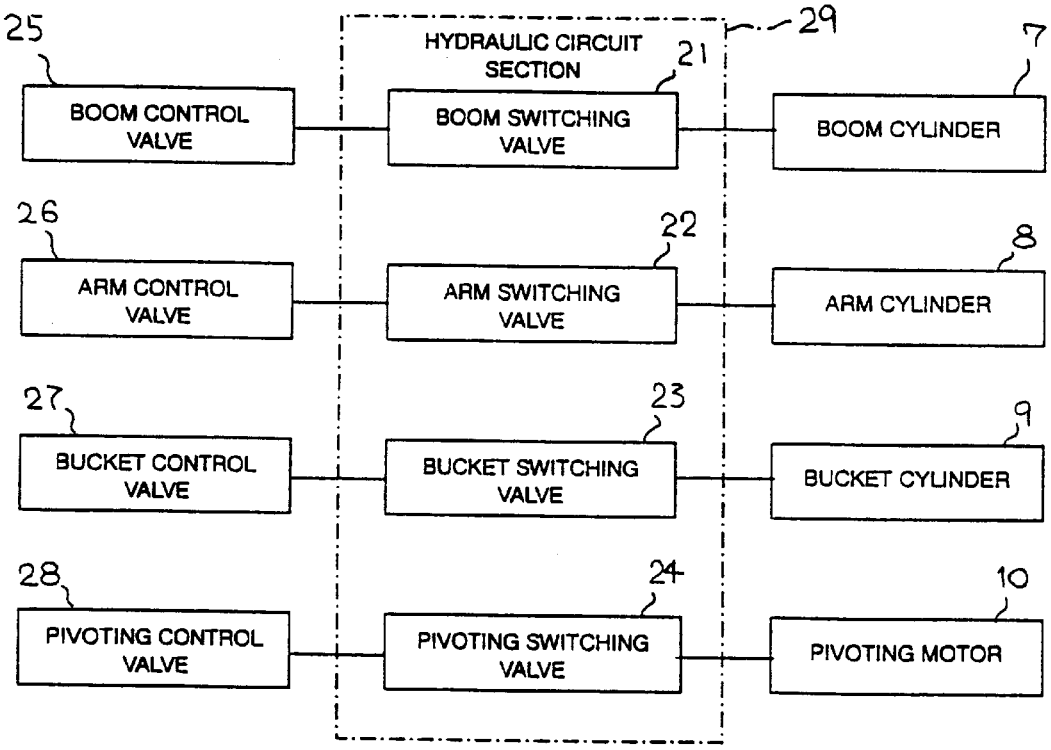
FIG. 2 is a schematic block diagram illustrating an important portion of the hydraulic circuit of the hydraulic excavator shown in FIG. 1.

FIG. 2 is a schematic block diagram illustrating an important portion of a hydraulic circuit of the hydraulic excavator shown in FIG. 1. In FIG. 2, switching valves 21 to 24 for switching between working directions (boom-up, boom-down, arm-crowd, arm-dump, bucket-crowd, bucket-dump, pivot-right, and pivot-left) are connected to individual cylinders 7 to 9 and a pivoting motor 10, respectively. The switching valves 21 to 24 are controlled by control valves (PPC valves) 25 to 28, respectively. In the hydraulic circuit section 29 having the above-mentioned switching valves 21 to 24, a tank, a hydraulic pump and the like (not shown) are of course provided, and a hydraulic circuit section of a known hydraulic excavator may also be utilized. For the details of the circuit configuration, therefore, various modifications are possible.

Figure 3:
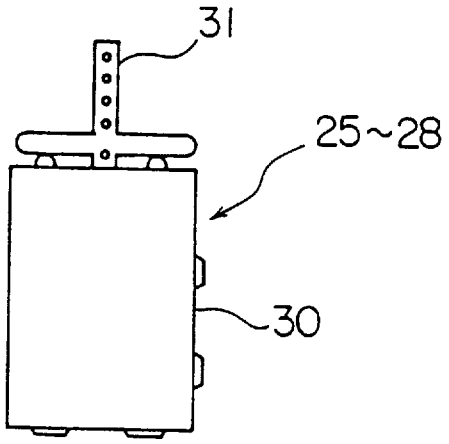
FIG. 3 is a schematic structural diagram illustrating a control valve shown in FIG. 2.

As shown in FIG. 3, each of the control valves 25 to 28 has a valve proper 30 and a valve operating lever 31 provided in this valve proper 30. The valve operating lever is pivotable to any of three positions including neutral and operating positions to the right and the left thereof, and automatically returns to the neutral position.

Figure 4:
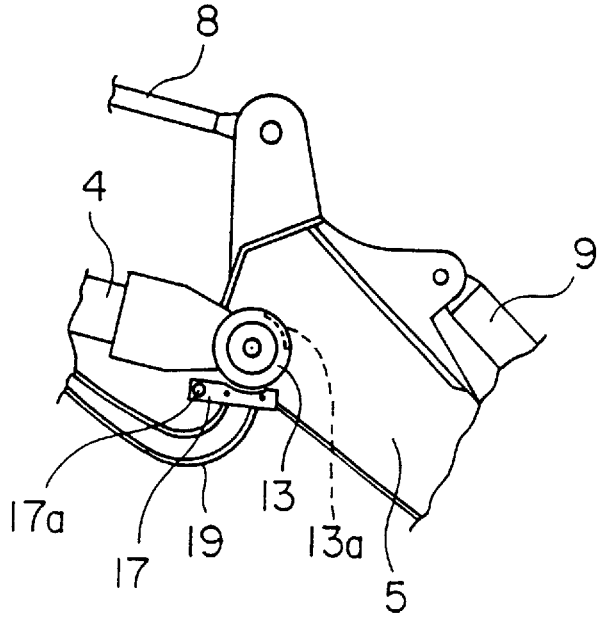
FIG. 4 is a front view illustrating attachment of the arm pulley shown in FIG. 1.
Figure 5:
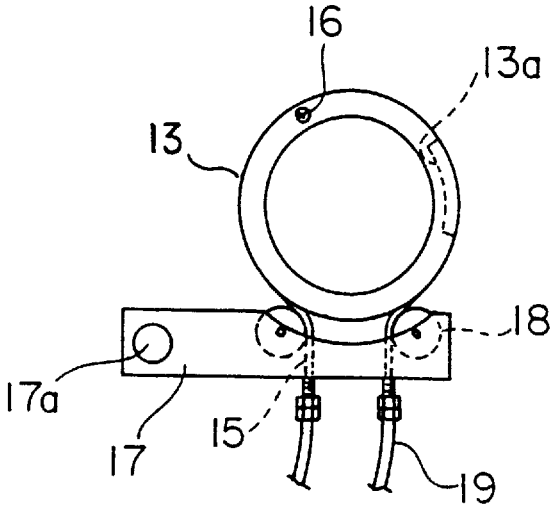
FIG. 5 is an enlarged front view of an important portion of FIG. 4.

FIG. 4 is a front View illustrating attachment of the arm pulley 13 shown in FIG. 1; and FIG. 5 is an enlarged front view illustrating an important portion of FIG. 4. FIG. 4 shows the junction between the boom 4 and the arm 5 shown in FIG. 1 as viewed from the back. An arcuate securing portion 13*a* is provided in the arm pulley 13, and is welded together with the arm 5. A working side cable 15 is wound around the outer periphery of the arm pulley 13. The working side cable 15 is secured at a point on the circumference of the arm pulley 13 by tightening a set screw 16 to the arm pulley 13.

The working side cable 15 is guided by a pair of rollers 18 provided pivotably on a cable guide 17 and drawn out from the arm pulley 13. The cable guide 17 is pivotably attached to the boom 4 around a fulcrum 17*a*. The working side cable 15 is slidably inserted smoothly into a cable tube 19, and directed to the operator's cab 2A by arranging the cable tube 19 along the boom 4. Further, the length of the cable tube 19 is adjustable at the attaching portion to the cable guide 17, thus permitting adjustment of tension of the working side cable 15 to some extent.

Although not shown, the working side cables 15 are wound also on the boom pulley 12 and the bucket pulley 14, and these working side cables 15 are introduced into the operator's cab 2A through identical structures.

Figure 6:
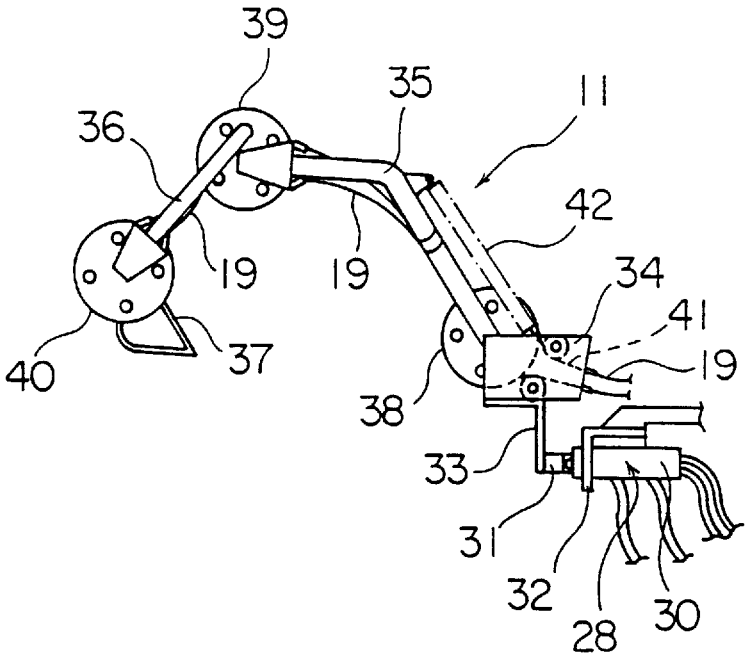
FIG. 6 is an enlarged structural diagram of the operating device shown in FIG. 1.

FIG. 6 is an enlarged structural diagram illustrating the operating device 11 shown in FIG. 1. In FIG. 6, the valve proper 30 of a pivoting control valve 28 for the pivoting motor 10 is secured to a securing member 32 fixed to the operator's cab 2A. A movable supporting member 33 is secured to a valve operating lever 31 of the pivoting control valve 28. The movable supporting member 33 is pivotable in the horizontal direction to the right and the left integrally with the valve operating lever 31 relative to the securing member 32.

An operating device base 34 is secured onto the movable supporting member 33. The base of a boom lever 35 serving as an operating side pivoting member is pivotably connected to this operating device base 34. An arm lever 36 serving as an operating side pivoting member is pivotably connected to the leading end of this boom lever 35. A bucket lever 37 serving as an operating side pivoting member is pivotably connected to the leading end of the arm lever 36. The bucket lever 37 serves also as a grip of the operating device 11, and is formed into a shape permitting easy grasping by the operator in the operator's cab 2A. It is also possible to mount electric switches and the like for operating incidental devices on the bucket lever 37.

A boom lever pulley 38, an arm lever pulley 39 and a bucket lever pulley 40 serving as operating side pulleys pivoting integrally with the individual levers 35, 36 and 37 are secured to the bases of the boom lever 35, the arm lever 36 and the bucket lever 37, respectively. Operating side cables 41 are wound around the outer peripheries of the individual lever pulleys 38 to 40, respectively, and are drawn out through a cable tube 19 shown in FIG. 5. Each of the operating side cables 41 is secured at one point on the circumference of each of the lever pulleys 38 to 40. A spring 42 is provided between the boom lever 35 and the operating device base 34 to prevent the operating device 11 from being pulled down by gravity.

Figure 7:
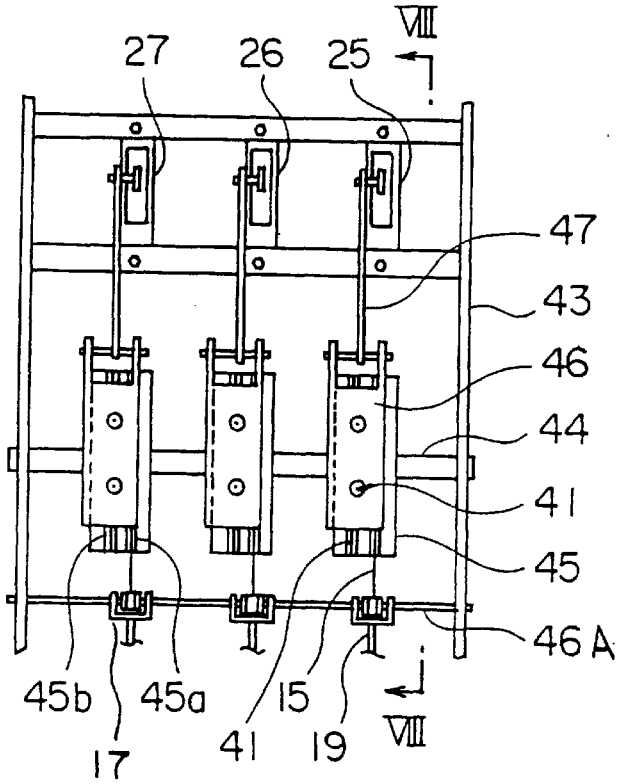
FIG. 7 is a plan view illustrating an important portion of the transmitting means in the first embodiment of the invention.
Figure 8:
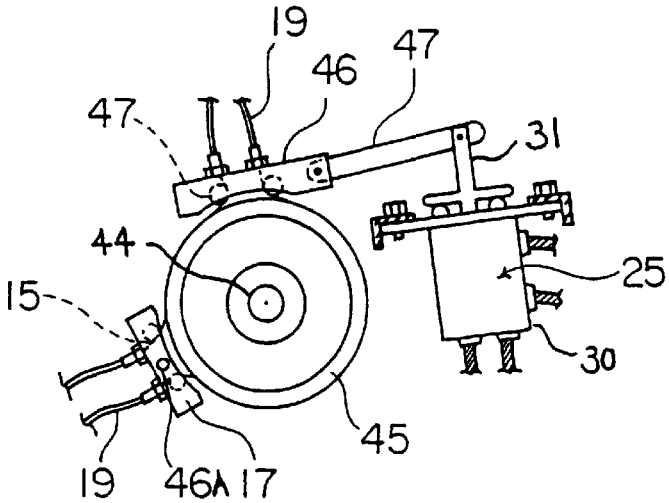
FIG. 8 is a sectional view of FIG. 7 cut along the line VIII—VIII.

FIG. 7 is a plan view illustrating an important portion of the transmitting means in the first embodiment of the invention; and FIG. 8 is a sectional view of FIG. 7 cut along the line VIII—VIII. In FIGS. 7 and 8, valve proper 30 of a boom control valve 25, an arm control valve 26 and a bucket control valve 27 are secured to a frame 43. For example, the frame 43 is housed in an appropriate space such as below the operator's cab 2A.

A main shaft 44 provided in the frame 43 is provided with three transmitting pivoting bodies corresponding to the control valves 25 to 27, i.e., transmitting pulleys 45. The other end of the corresponding working side cable 15 is wound on each transmitting pulley 45. These working side cables 15 are each secured to a point on the circumference of the individual transmitting pulleys 45. Therefore, the individual transmitting pulleys 45 pivot in conjunction with (in synchronization with) the corresponding working side pulleys 12 to 14, respectively. A cable guide 17 substantially the same as that shown in FIG. 5 is supported by a supporting shalt 46A provided in the frame 43. An end of the cable tube 19 for the working side cables 15 is connected to this cable guide 17.

A groove 45*a* for the working side cables 15 and another groove 45*b* parallel to this groove 45*a* are provided in the outer periphery of each transmitting pulley 45, and the corresponding operating side cables 41 are wound on the groove 45*b*. These operating side cables 41 are each secured as well to one point on the circumference of each transmitting pulley 45.

The operating side cables 41 wound on the transmitting pulleys 45 are guided by a pair of rollers 47 provided on displacement members (crabs) 46, and drawn out from the transmitting pulleys 45 through the displacement members 46. These displacement members 46 have substantially the same construction as that of the cable guide 17, but are not secured to the frame 43 or the transmitting pulleys 45, and are reciprocable in the circumferential direction of the transmitting pulleys 45. Each displacement member 46 is connected through a plate-shaped connecting link 47 to a valve operating lever 31 of each of the corresponding control valves 25 to 27.

The transmitting means in this embodiment comprises working side pulleys 12 to 14, working side cables 15, operating side pulleys 38 to 40, operating side cables 41, transmitting pulleys 45, displacement members 46 and connecting links 47.

Now, operation of the present invention will be described below. An operator sitting in the operator's cab 2A holds the bucket lever 37 of the operating device 11, and moves the bucket lever 37 while watching the bucket 6 and the working site so as to cause movement of the bucket 6. This causes all the articulated parts of the operating device 11 to pivot.

For example, when the boom lever 35 pivots counterclockwise (downward direction) in FIG. 6, the boom lever pulley 38 pivots similarly along with this. Since the operating side cable 41 is secured to this boom lever pulley 38, pivoting of the boom lever pulley 38 pulls one side of the operating side cable 41, and this tensile force is also transmitted to the ends of the operating side cable 41 of the transmitting pulley 45. However, in this stage, the actual boom 4 is at a standstill, and the transmitting pulley 45 in conjunction with the boom pulley 12 does not move. Therefore, the displacement member 46 moves toward the pulled operating side cable 41. Assume here that the operating side cable 41 on the right side in FIG. 8 is pulled, and the operating side cable 41 is fed to make the displacement member 46 move to the right in the figure.

The movement of the displacement member 46 causes operation of the valve operating lever 31 of the boom control valve 25 through the connecting link 47. At this point, the piping of the hydraulic circuit section 29 has a structure in which the boom 4 pivots in the same direction as the boom lever 35. Consequently, the boom 4 pivots in the same direction as the boom lever 35 after a slight delay therefrom. When the boom 4 pivots, as described above, this movement is transmitted through the boom pulley 12 and the working side cable 15 to the corresponding transmitting pulley 45, which pivots counterclockwise in FIG. 8.

Pivoting of the transmitting pulley 45 feeds the operating side cable 41 to the right-hand cable tube 19 in FIG. 8, and the operating side cable 41 is drawn out from the left-hand cable tube 19. Therefore, the displacement member 46 tends to move to the left in FIG. 8, i.e., in the restoring direction. When pivoting of the boom lever 35 stops at this point, the displacement member 46 moves back to the original position and stops there, and the boom control valve 25 returns to the neutral state. Pivoting of the boom 4 also stops. When pivoting of the boom lever 35 continues, the displacement member 46 continues to displace, and the boom 4 continues to pivot until stoppage of the boom lever 35. When the boom lever 35 is operated in the reverse direction, the above-mentioned movement is in the reverse direction. For the arm 5 and the bucket 6 as well, operation is performed similarly.

Therefore, if the transmitting pulley 45 rotates and can thus feed and wind the cables 15 and 41 so as not to prevent movement of the working device 3 and the operating device 11, it is possible to ensure smooth movement of the working device 3 in conjunction with the movement of the operating device 11.

Now, pivoting operation will be described below. When the entire operating device 11 is pivoted in a desired direction, while still grasping the bucket lever 37, the valve operating lever 31 of the pivoting control valve 28 is directly operated, thus causing the entire upper pivoting body 2 to pivot in the same direction. As a result of this pivoting operation, the valve proper 30 of the pivoting control valve 28 secured to the upper pivoting body 2 pivots, and the valve operating lever 31 thereof is brought relatively back to the neutral position. Therefore, while the operating device 11 pivots in the pivoting direction, the upper pivoting body 2 pivots in the same direction, and upon stoppage of pivoting of the operating device 11, pivoting of the upper pivoting body 2 stops.

Since the link mechanism of the working device 3 can be smoothly operated by following along with the link mechanism of the operating device 11, the operator can operate the operating device 11 with a sense of directly operating the working device 3. Since the link mechanism of the operating device 11 automatically follows along through the shortest distance if the bucket lever 37 is moved, it is not necessary to worry about the individual angles of the links, etc. It is thus possible to improve working efficiency without requiring any special skill, and great reductions in total work time can be achieved.

Further, the pivoting members of the working device 3 correspond to those of the operating device 11 at a ratio 1:1. It is not therefore necessary to take account of the comparative speed of the arm 5 relative to the boom 4 operation or the comparative amount of displacement, and the construction of the equipment is simple. Therefore, complicated control at a distributor is not necessary, and only a single pump need be provided in the hydraulic circuit section 29, permitting considerable reduction of cost By securing the working side cables 15 to the working side pulleys 12 to 14 and securing the operating side cables 41 to the operating side pulleys 38 to 40 with set screws 16, it is possible to easily accomplish initial position setting between the operating device 11 and the working device 3 and adjustment of a play.

The means for interlocking the working side pivoting members and the transmitting pivoting bodies is not limited to the example described above, but may be a flexible cable in which the cable itself rotates in the tube, or the like, or pivoting of the working side pivoting members may be detected with a sensor and the transmitting pivoting bodies may be caused to pivot in conjunction with an output thereof by means of a servo motor.

Second Embodiment

Figure 9:
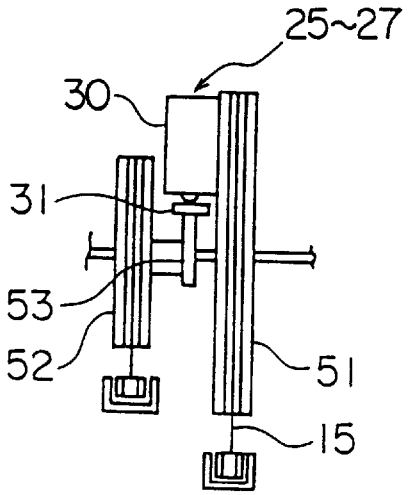
FIG. 9 is a schematic plan view illustrating an important portion of a hydraulic excavator in a second embodiment of the invention.
Figure 10:
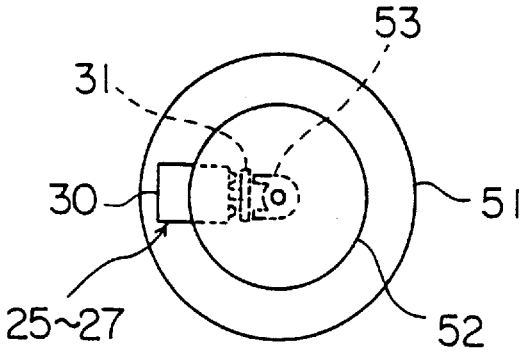
FIG. 10 is a partial side view of FIG. 9.

FIG. 9 is a schematic plan view illustrating an important portion of a hydraulic excavator in a second embodiment of the invention; and FIG. 10 is a side view of an important portion of FIG. 9. In this embodiment, control valves 25 to 27 are mounted on a first transmitting pulley 51 serving as a first transmitting pivoting body pivoting in conjunction with pivoting of working side pulleys 12 to 14 similar to those in the first embodiment, and a valve proper 30 thereof is secured. An operating member 53 for operating a valve operating lever 31 is secured to a second transmitting pulley 52 serving as a second transmitting pivoting body pivoting in conjunction with pivoting of lever pulleys 38 to 40 as shown in FIG. 6. The first and the second transmitting pulleys 51 and 52 are provided on the same shaft and pivot independently of each other. The other aspects of the configuration are substantially the same as in the above-mentioned first embodiment In the equipment as described above, pivoting of the second transmitting pulley 52 by the operating device 11 causes pivoting of the operating member 53, and hence operation of the valve operating lever 31. When this leads to pivoting of the boom 4, the arm 5 and the bucket 6, the first transmitting pulley 51 pivots in conjunction with this. At this point, the first transmitting pulley 51 pivots in a direction to bring the mounted control valves 25 to 27 back to the neutral state, i.e., in the same direction as the second transmitting pulley 51.

It is thus possible to achieve smooth operation of the link mechanism of the working device 31, imitating the link mechanism of the operating device 11.

Third Embodiment

Figure 11:
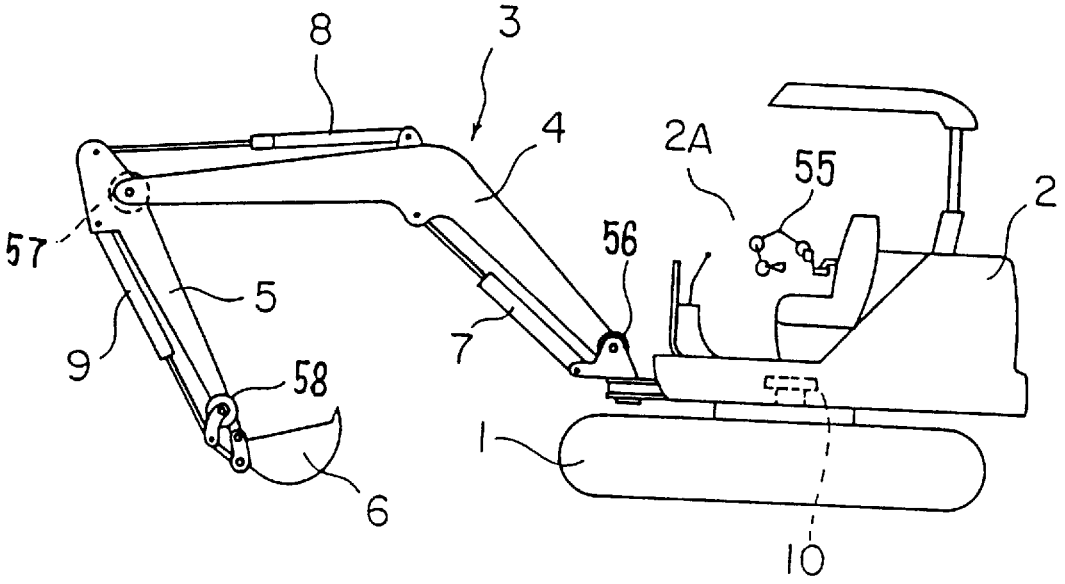
FIG. 11 is a schematic side view illustrating a hydraulic excavator in a third embodiment of the invention.

FIG. 11 is a schematic side view illustrating a hydraulic excavator in a third embodiment of the invention. In FIG. 11, an operating device 55 forming a link mechanism identical with the link mechanism of the working device 3, reduced in size at an appropriate ratio is provided in the operator's cab 2A. A boom sensor 56 detecting pivoting of the boom 4 is provided at the base of the boom 4. An arm sensor 57 detecting pivoting of the arm 5 is provided at the junction between the boom 4 and the arm 5. A bucket sensor 58 detecting pivoting of the bucket 6 is provided in a portion of the link mechanism for causing pivoting of the bucket 6. Known rotation sensors that provide electric signals in response to a state of rotation, such as potentiometers, may be appropriately selected for use as these sensors 56 to 58.

Figure 12:
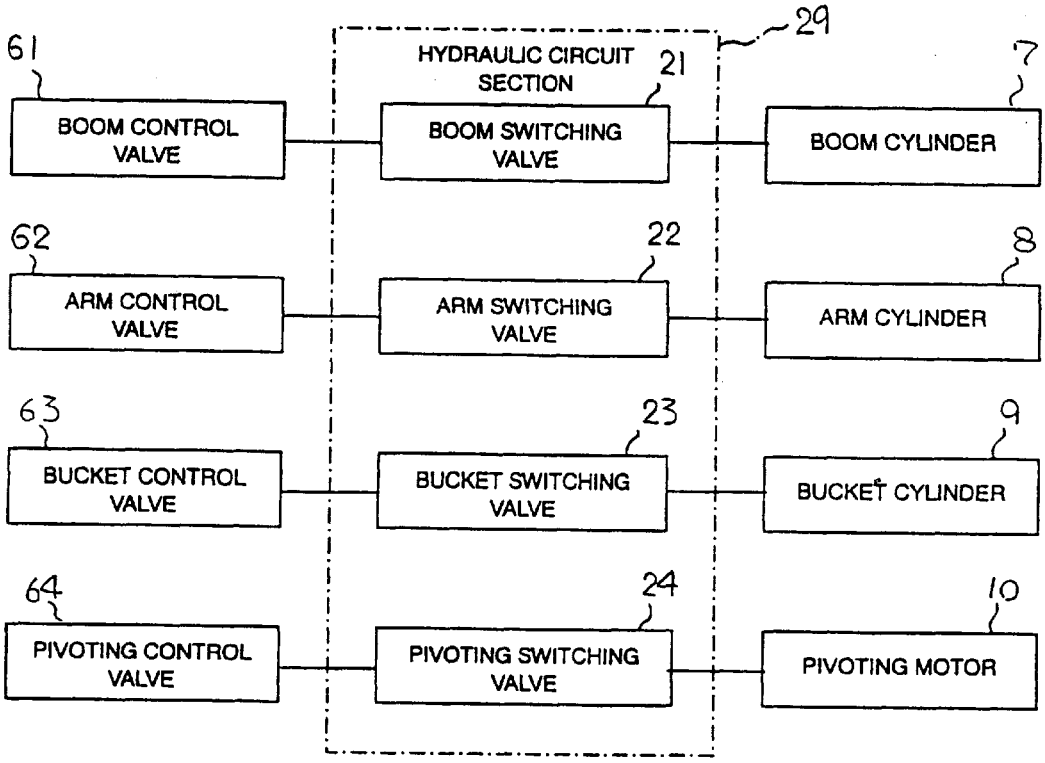
FIG. 12 is a schematic block diagram illustrating an important portion of the hydraulic circuit of the excavator shown in FIG. 11.

FIG. 12 is a schematic block diagram illustrating an important portion of the hydraulic circuit of the hydraulic excavator shown in FIG. 11: the configuration is the same as in the foregoing first embodiment except for a boom control valve 61, an arm control valve 62 and a bucket control valve 63.

Figure 13:
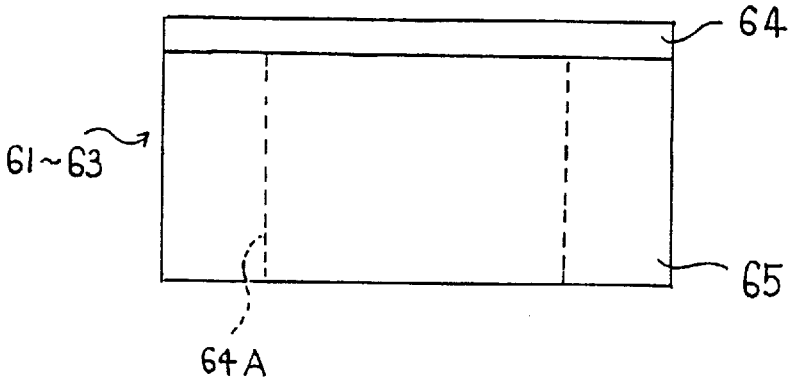
FIG. 13 is a plan view illustrating control valves for the boom, arm and bucket shown in FIG. 12.

FIG. 13 is a plan view illustrating control valves 61 to 63 for the boom, the arm and the bucket The control valves 61 to 63 are each provided with a first valve piece 64 having a cylindrical portion 64A, and a second valve piece 65 having the cylindrical portion 64A inserted therein and serving as a ring portion pivotably combined with the first valve piece 64.

Figure 14:
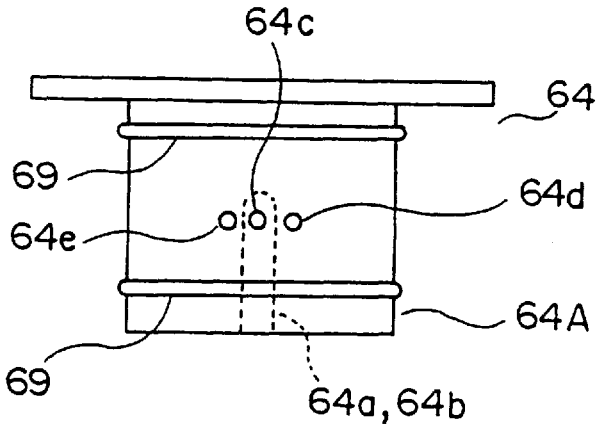
FIG. 14 is a plan view illustrating a first valve piece shown in FIG. 13.
Figure 15:
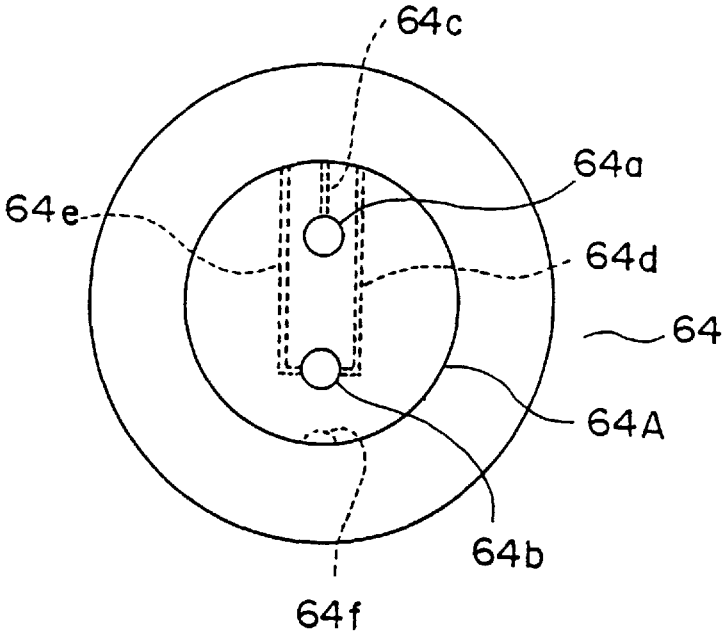
FIG. 15 is a front view of FIG. 14.
Figure 16:
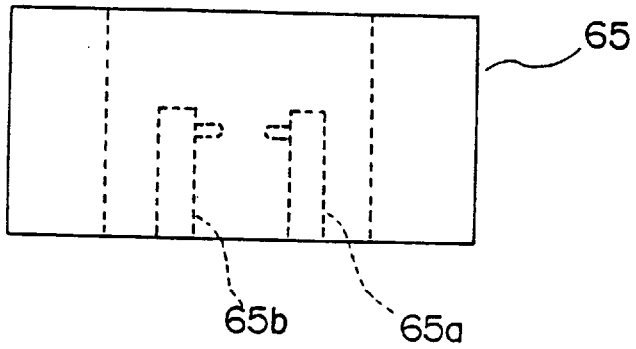
FIG. 16 is a plan view illustrating a second valve piece shown in FIG. 13.
Figure 17:
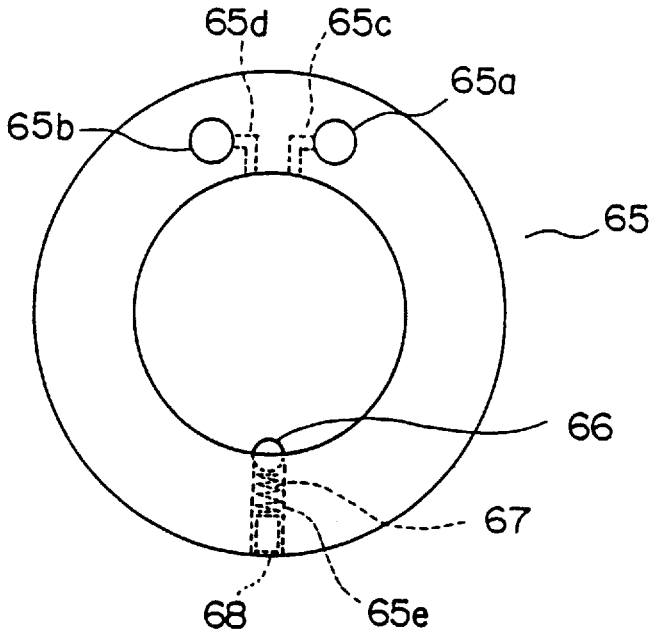
FIG. 17 is a front view of FIG. 16.

FIG. 14 is a plan view illustrating the first valve piece 64 shown in FIG. 13; FIG. 15 is a frontview of FIG. 14; FIG. 16 is a plan view illustrating the second valve piece 65 shown in FIG. 13; and FIG. 17 is a front view of FIG. 16. Each of the valve pieces 64 and 65 is provided with two ports, i.e., first to fourth ports 64*a*, 64*b*, 65*a* and 65*b*.

The first valve piece 64 comprises a first channel 64*c* having an end communicating with the first port 64*a* and the other end opening to a sliding surface with the second valve piece 65, and a second and a third channels 64*d* and 64*e* having an end communicating with the second port 64*b* and the other end opening to sliding surfaces on both sides of the channel 64*c*. The second valve piece 65 comprises a fourth channel 65*c* having an end communicating with the third port 65*a* and the other end opening to a sliding surface with the first valve piece 64, and a fifth channel 65*d* having an end communicating with the fourth port 65*b* and the other end opening to a sliding surface.

A recess 64*f* having an isosceles triangular cross-section at a position 180° from the opening of the first channel 64*c* on the outer periphery of the first valve piece 64, i.e., on the opposite portion. The second valve piece 65 has a screw hole 65*e* passing through in the radial direction. A pressing piece 66 having a leading end to be inserted into the recess 64*f* and a pressing spring 67 pressing the pressing piece 66 against the recess 64*f* are inserted into the screw hole 65*e*. An adjusting screw 68 for adjusting the end position of the pressing spring 67 is screwed into the screw hole 65*e*. Further, two sealing rings 69 are provided on the outer periphery of the first valve piece 64.

In these control valves 61 to 63, relative pivoting of the first valve piece 64 to the second valve piece 66 switches over the neutral position and the right and left operating positions, forming four-port three-position valves. When the pressing piece 66 is pressed by the pressing spring 67 against the recess 64*f*, the pressing piece 66 tends to move within the recess 64*f* toward the center thereof, thus performing automatic return to the neutral position. A spherical piece or one having a triangular tip may be used as the pressing piece 66.

Figure 18:
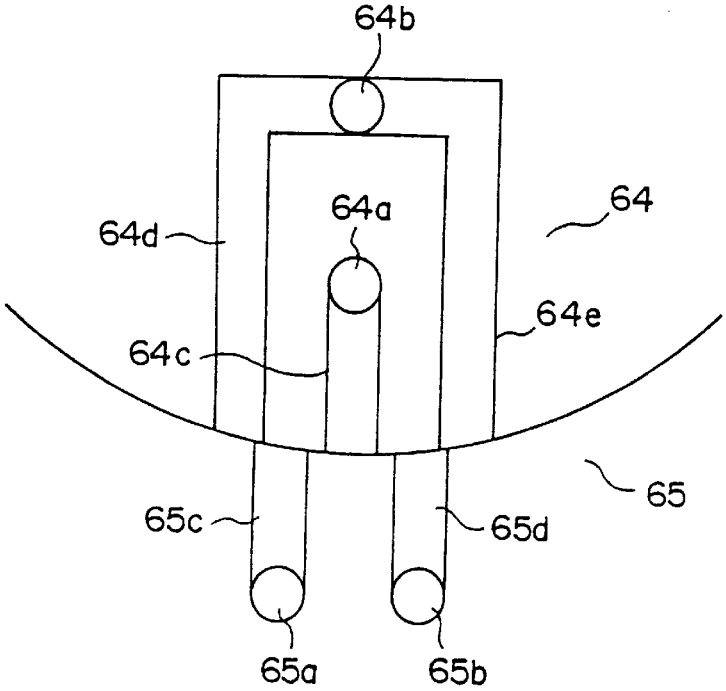
FIG. 18 is a descriptive view illustrating a neutral state of the control valve shown in FIG. 13.

FIG. 18 is a descriptive view illustrating the neutral state of the control valves 61 to 63 shown in FIG. 13. In the neutral state, the port 64*a* and the channel 64*c* of the first valve piece 64 do not communicate with any of the channels 65*c* and 65*d* of the second valve piece 65. The openings of the channels 64*d* and 64*e* of the first valve piece 64 slightly (for example, about 0.5 mm for a channel diameter of 3 mm) overlap the openings of the channels 65*c* and 65*d* of the second valve piece 65, respectively, and the ports 65*a* and 65*b* communicate with the port 64*b*.

Figure 19:
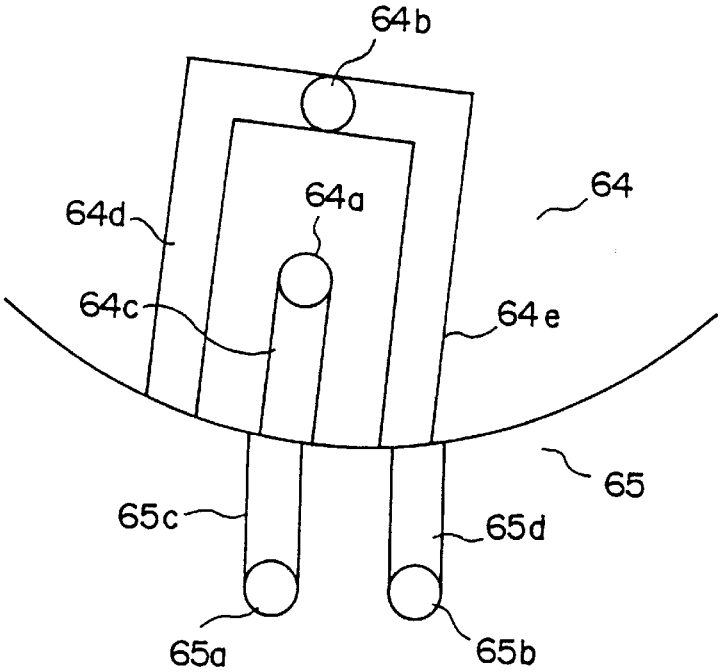
FIG. 19 is a descriptive view illustrating a pivoted state of the first valve piece shown in FIG. 18.

When the first valve piece 64 pivots relative to the second valve piece 65 from the state shown in FIG. 18 to another state such as the one shown in FIG. 19, the port 64*a* of the first valve piece 64 communicates with either of the ports 65*a* and 65*b* of the second valve piece 65, and the port 64*b* of the first valve piece 64 communicates with either of the ports 65*a* and 65*b* of the second valve piece 65. In response to the direction of such a relative pivoting, therefore, the channels are switched over, thereby switching over the corresponding switching valve 21 to 23.

Figure 20:
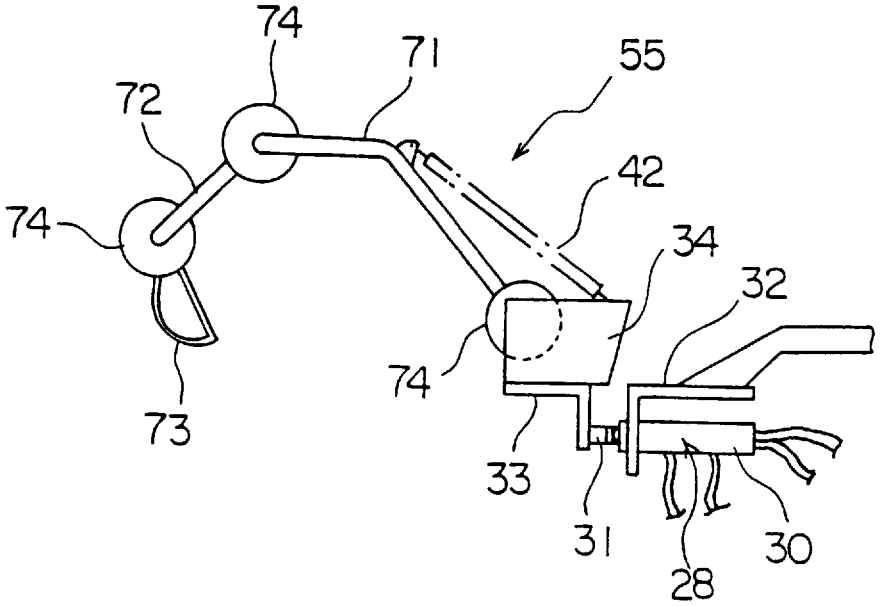
FIG. 20 is an enlarged structural diagram of the operating device shown in FIG. 11.

FIG. 20 is an enlarged structural diagram illustrating the operating device 55 shown in FIG. 11. In FIG. 20, an operating device base 34 is secured to a movable supporting member 33, as in the above-mentioned first embodiment. The base of a boom lever 71 serving as an operating side pivoting member is pivotably connected to the operating device base 34. An arm lever 72 serving as an operating side pivoting member is pivotably connected to the leading end of this boom lever 71. Further, a bucket lever 73 serving as an operating side pivoting member is connected to the leading end of the arm lever 72. The bucket lever 73 serves also as a grip for the operating device 55, and is formed into a shape permitting easy grasping by the operator in the operator's cab 2A. It is possible to mount electric switches and the like for operating incidental devices on the bucket lever 73.

Valve motor assemblies 74 are present between the operating device base 34 and the boom lever 71, between the boom lever 71 and the arm lever 72, and between the arm lever 72 and the bucket lever 73, respectively. A spring 42 for compensating the gravity of the operating device 55 is provided between the boom lever 71 and the operating device base 34.

Figure 21:
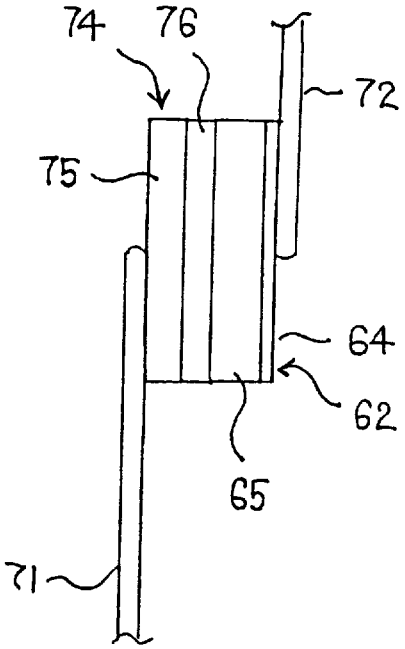
FIG. 21 is a schematic structural diagram illustrating the valve motor assembly shown in FIG. 20.

FIG. 21 is a schematic structural diagram illustrating the valve motor assembly 74 shown in FIG. 20, showing an example arranged between the boom lever 71 and the arm lever 72. A servo motor 75 is secured to the boom lever 71. The second valve piece 65 of the arm control valve 62 is connected through a gear device 76 such as a planetary gear to the servo motor 75. An arm lever 72 is secured to the first valve piece 64 of the arm control valve 62. The servo motor 75 causes the second valve piece 65 to pivot through the gear device 76 in response to a signal from the arm sensor 57 shown in FIG. 1.

The servo motor 75 and the gear device 76 are set so that the second valve piece 65 cannot pivot beyond an operating range of the arm control valve 62 from the arm lever 72 side. The other two valve motor assemblies 74 have the same configuration. The transmitting means in another example has sensors 56 to 58, a servo motor 75 and a gear device 76.

Now, functions will be described below. An operator in the operator's cab 2A holds the bucket lever 73, and moves the bucket lever 73 to cause displacement of the bucket 6 while visually watching the bucket 6 and the working site. This causes pivoting of various articulated portions of the operating device 55.

For example, when the boom lever 71 begins pivoting counterclockwise (downward) in FIG. 11, the first valve piece 64 of the boom control valve 61 to which the boom lever 71 is secured also simultaneously pivots within the operating range thereof. Pivoting of the first valve piece 64 causes switching of the boom switching valve 21 and driving of the boom cylinder 7, and the boom 4 of the working device 3 pivots in the same direction as that of the boom lever 72.

When the boom 4 pivots as described above, pivoting is detected by the boom sensor 56. The servo motor 75 secured to the operating device base 34 is driven, and the second valve piece 65 of the boom control valve 61 is caused to pivot in a direction bringing the boom control valve 621 back to the neutral state, i.e., in the same direction as that of the first valve piece 64. By causing continuous pivoting of the boom lever 71, therefore, the second valve piece 65 pivots, along with the pivoting of the boom lever 71, and the boom 4 continuously pivots.

When pivoting of the boom lever 71 stops, the boom control valve 61 remains in the neutral state, and pivoting of the boom 4 is also discontinued. When the boom lever 71 is operated in the reverse direction, the steps described above are in the reverse direction. The arm 5 and the bucket 6 are operated in the same manner as the boom 4. Pivoting operation is the same as in the first embodiment described above.

Since the link mechanism of the working device 3 can be smoothly operated by following along with the link mechanism of the operating device 55, the operator can operate the operating device 55 with a sense of directly operating the working device 3. Since the link mechanism of the operating device 55 automatically follows along through the shortest distance, it is not necessary to worry about the angle or the like of the individual links. It is thus possible to improve working efficiency without requiring any special skill, and great reductions in total work time can be achieved.

It is not necessary to provide complicated control at the distributor. It suffices to install a single pump in the hydraulic circuit 29, thus permitting considerable reduction of cost.

Sending of signal from the sensors 56 to 58 to the servo motor 75 can be accomplished by arranging lead wires, or may be performed in a wireless manner, thus avoiding occurrence of a failure caused by breakage of the lead wires.

Fourth Embodiment

Figure 22:
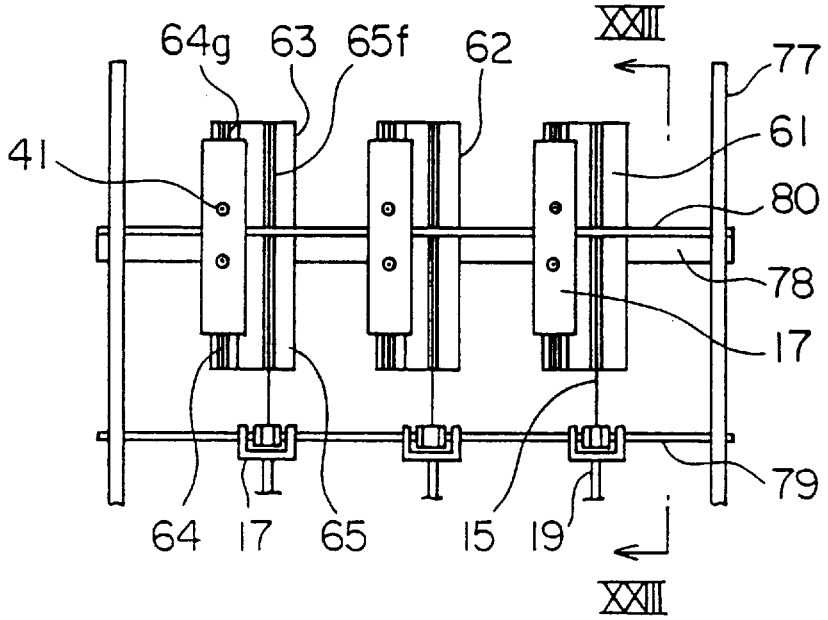
FIG. 22 is a plan view illustrating an important portion of transmitting means of a hydraulic excavator in a fourth embodiment of the invention.
Figure 23:
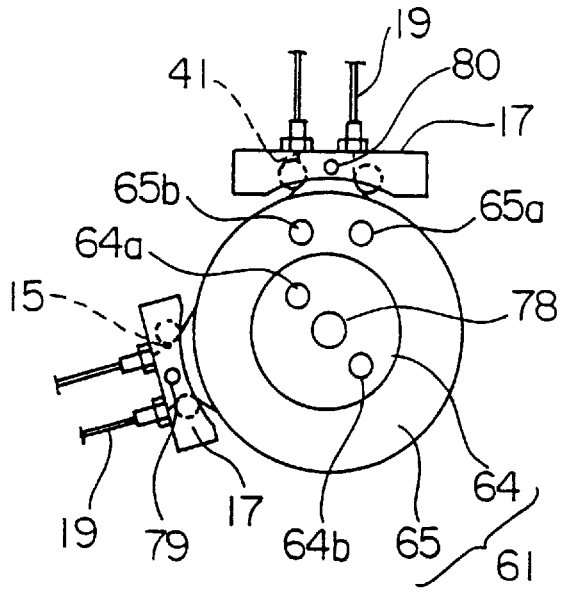
FIG. 23 is a sectional view of FIG. 22 cut along the line XXIII—XXIII.

Now, a fourth embodiment of the invention will be described below. In this embodiment, the structure on the working device 3 side is the same as in the first embodiment described above, and the operating device 11 shown in FIG. 6 is employed. FIG. 22 is a plan view illustrating an important portion of transmitting means of a hydraulic excavator in the fourth embodiment of the invention; and FIG. 23 is a sectional view of FIG. 22 cut along the line XXIII—XXlll. In FIGS. 22 and 23, a main shaft 78 is provided in a frame 77 housed in an appropriate space such as that below the operator's cab 2A. Control valves 61 to 63 having the same functions as those in the foregoing third embodiment are supported by the main shaft 78. In each of these control valves 61 to 63, first and second valve pieces 64 and 65 can independently pivot. Illustration of piping to the individual control valve 61 to 63 is omitted here.

A groove 65*f* is formed on the outer periphery of each second valve piece 65. The other ends of the corresponding working side cables 15 are wound around these grooves 65*f*, respectively. These working side cables 15 are secured to a point on the circumference of the second valve pieces 65. The individual second valve pieces 65 therefore pivot in conjunction (in synchronization) with the corresponding pulleys 12 to 14 on the working device 3 side. A cable guide 17 substantially the same as that shown in FIG. 5 is supported by a supporting shaft 79 provided in a frame in parallel with the main shaft 78, and an end of a cable tube 19 for the working side cables 15 is connected to this cable guide 17.

A groove 64*g* parallel to the groove 65*f* is formed on the outer periphery of each first valve piece 64, and corresponding operating side cables 41 are wound around these grooves 64*g*. These operating side cables 41 are all secured to a point on the circumference of the individual first valve pieces 64. A cable guide 17 substantially the same as that shown in FIG. 5 is supported by a supporting shaft 80 provided in the frame 77 in parallel with the main shaft 78, and an end of the cable tube 19 for the operating side cables 41 is connected to the cable guide 17.

The transmitting means in this embodiment comprises working device 3 side pulleys 12 to 14, working side cables 15, lever pulleys 38 to 40, operating side cables 41, the cable guide 17, the frame 77, the main shaft 78, and the supporting shafts 79 and 80.

Now, operations will be described below. The operator in the operator's cab 2A holds the bucket lever 37 of the operating device 11, and moves the bucket lever 37 while watching the bucket 6 and the working site so as to displace the bucket 6. This causes the individual articulated portions of the operating device 11 to pivot.

For example, when the boom lever 35 pivots counterclockwise (downward) in FIG. 6, the boom lever pulley 38 similarly pivots along with this. Pivoting of the boom lever pulley 38 is transmitted through the operating side cables 41 to cause the corresponding first valve piece 64 to pivot. Because the second valve piece 65 is in stoppage at this point, the first valve piece 64, pivots relative to the second valve piece 65, thus operating the boom control valve 61.

At this point, piping for the hydraulic circuit section 29 has a configuration in which the boom 4 pivots in the same direction as the boom lever 35. The boom 4 therefore pivots in the same direction with a slight delay from pivoting of the boom lever 35. When the boom 4 pivots as described above, the movement thereof is transmitted to the corresponding second valve piece 65 through the boom pulley 12 and the working side cable 15, and the second valve piece 65 pivots in a direction bringing the boom control valve 61 back to the neutral state, i.e., in the same direction as the first valve piece 64.

When the boom lever 61 continuously pivots, therefore, the pivoting is followed to cause the second valve piece 65 to pivot, and the boom 4 to pivot continuously. When pivoting of the boom lever 61 is discontinued, the boom control valve 61 remains in the neutral state, and boom 4 pivoting stops. When the boom lever 61 is operated in the reverse direction, the foregoing steps are in the reverse direction. The arm 5 and the bucket 6 are also operated in the same manner as the boom 4. Pivoting operation is the same as in the foregoing first embodiment.

In the above-mentioned fourth embodiment, the movement of the working device 3 is transmitted to the second operating piece 65 by means of the pulleys 12 to 14 and the working side cables 15, but as shown in the foregoing third embodiment, it is also possible to transmit the movement through the sensors 56 to 58, the servo motor 75 and the gear device 76.

It is also possible to transmit the movement of the operating device and the working device to the first and the second operating pieces through a sensor and a servo motor. In this case, it is appropriate to attach to the operating device a hydraulic damper or the like to provide some resistance to the operator's operating input so as not to allow the operating device to be operated largely beyond the followable speed range of the working device.

Further, in place of the cables 15 and 41, a flexible cable which rotates in the tube or the like may be employed.

Fifth Embodiment

Figure 24:
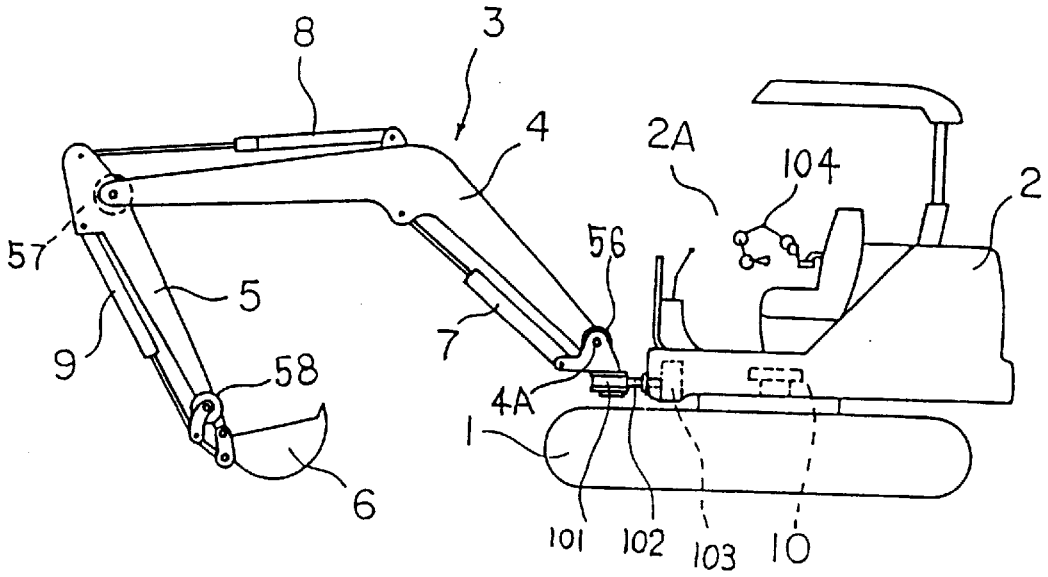
FIG. 24 is a schematic side view illustrating a hydraulic excavator in a fifth embodiment of the invention.

FIG. 24 is a schematic side view illustrating a hydraulic excavator in a fifth embodiment of the invention. In FIG. 24, a boom 4 is supported by a boom support 101, pivotably in a direction permitting vertical movement of the leading end thereof around a boom axis 4A. The boom support 101 is secured to the leading end of a twisting shaft 102 extending in a direction at right angles to the boom axis 4A (right-left direction in FIG. 19) in a plane parallel to the plane in which a lower propulsion unit 1 is placed. The twisting shaft 102 is caused to pivot directly by a twisting hydraulic motor 103 mounted on an upper pivoting body 2, or indirectly via a gear or the like. A twist switching valve for switching over the direction of rotation of the twisting hydraulic motor 103 is provided in a hydraulic circuit section not shown. A twist sensor (not shown) detecting the pivoting angle is provided on the twisting shaft 102. An operating device 104 comprising a link mechanism identical with the link mechanism of the working device, reduced in size at an appropriate ratio, is provided in the operator's cab 2A.

Figure 25:
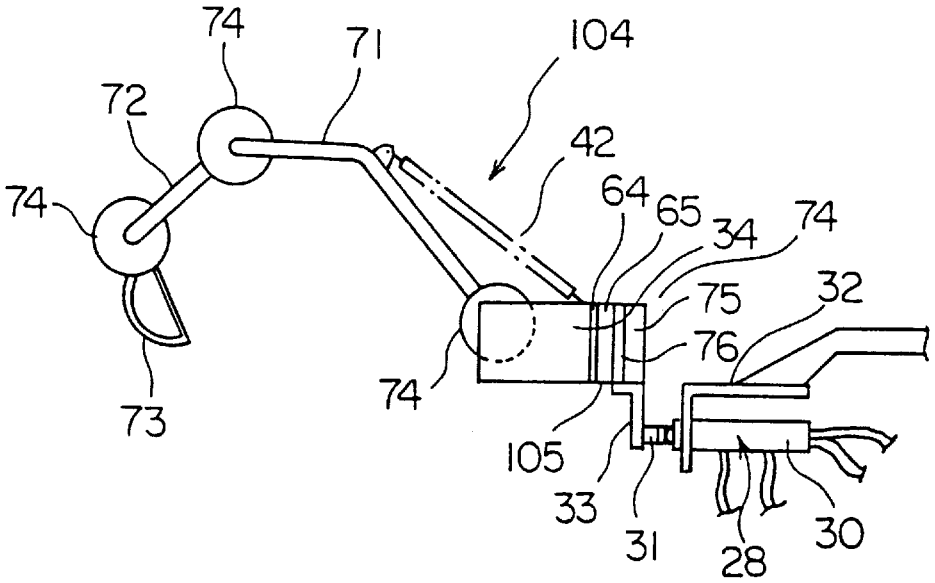
FIG. 25 is an enlarged structural diagram of the operating device shown in FIG. 24.

FIG. 25 is an enlarged structural diagram illustrating the operating device shown in FIG. 20. The operating device 104 comprises an operating device base 34 similar to that shown in FIG. 20 supported by a movable supporting member 33 via a valve motor assembly 74. As a result, the operating device base 34 is pivotable around an axis parallel to the twisting shaft 102. This valve motor assembly 74 comprises a twist control valve 105 for controlling the twisting hydraulic motor 103, a servo motor 75 driven in response to a signal from a twist sensor provided on the twisting shaft 102, and a gear device 76, and has the same structure as that shown in FIG. 21. The other portions of the configuration are the same as in the foregoing third embodiment.

In such a hydraulic excavator, the working device 3 can be made to lay down by having the twisting shaft 102 pivot thus permitting work such as scraping and gathering earth and sand to be carried out smoothly.

In a conventional hydraulic excavator requiring two operating levers, both hands of the operator are occupied, and therefore, the number of operating directions is limited. According to the present invention, in contrast, it is possible to operate a single operating device 104 with one hand, and further, to increase the number of operable directions.

In the foregoing embodiment, the twisting hydraulic motor 103 is operated by the operating device 104. It is also possible to use an operating device identical with that shown in FIG. 20, and to operate the twisting hydraulic motor 103 with another operating lever or pedal.

Sixth Embodiment

Figure 26:
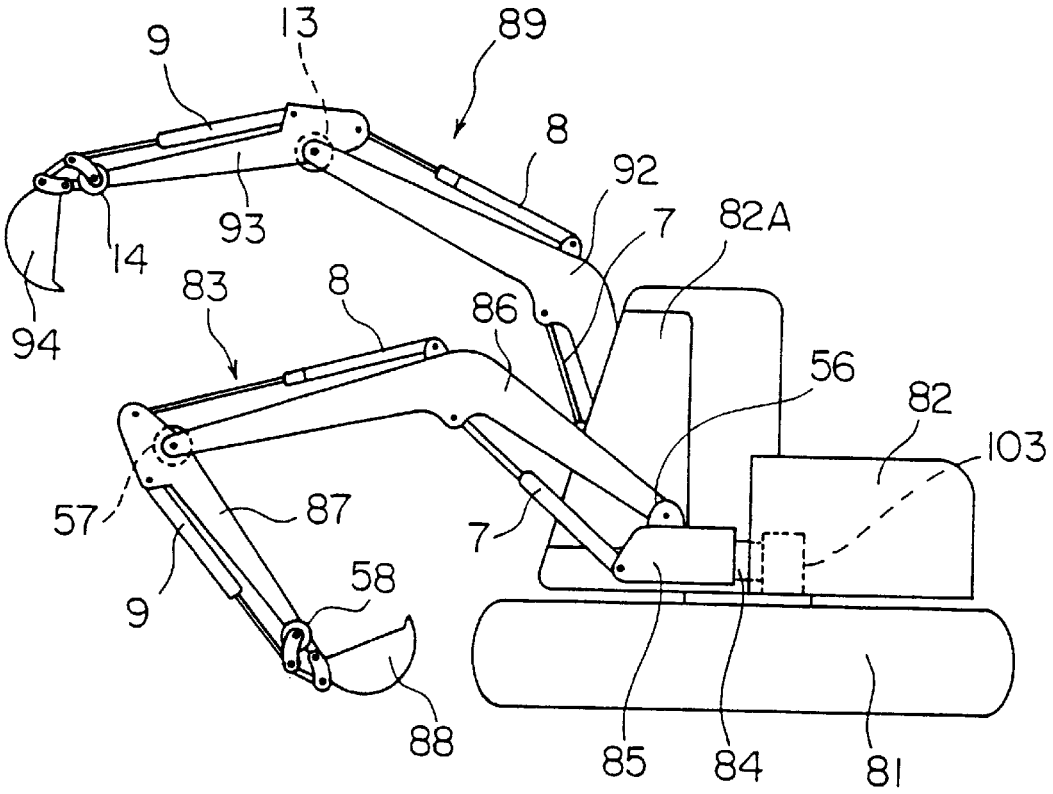
FIG. 26 is a side view illustrating a hydraulic excavator in a sixth embodiment of the invention.
Figure 27:
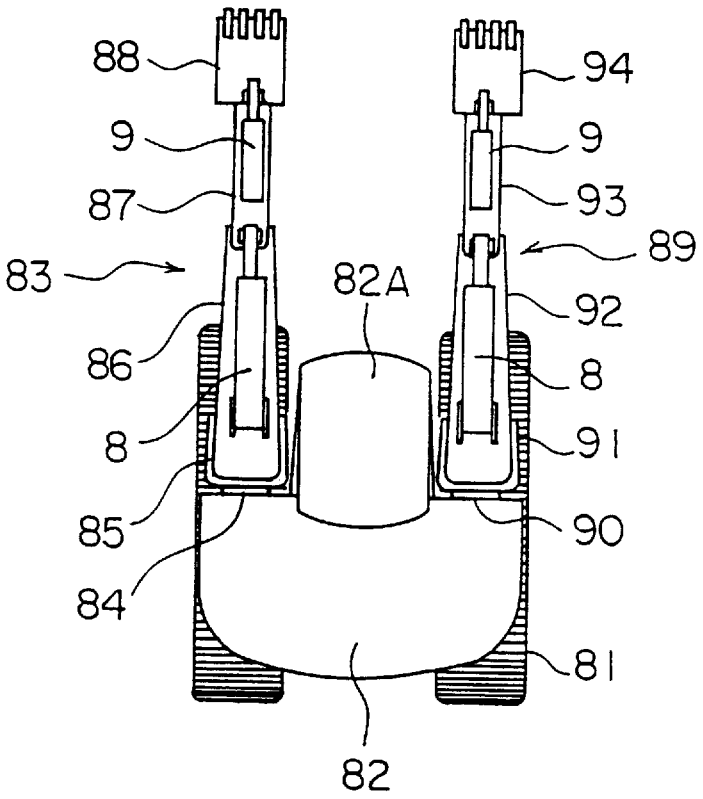
FIG. 27 is a plan view illustrating the hydraulic excavator shown in FIG. 26.

FIG. 26 is a side view illustrating a hydraulic excavator in a sixth embodiment of the invention; and FIG. 27 is a plan view illustrating the hydraulic excavator shown in FIG. 26. In FIGS. 26 and 27, an upper pivoting body 82 having an operator's cab 82A is pivotably provided on a lower propulsion unit 81. The heavy equipment body comprises the lower propulsion unit 81 and the upper pivoting body 82. First and second working devices 83 and 89 are mounted to the right and left of the operator's cab 82A of the upper pivoting body 82.

The first working device 83 comprises a first twisting shaft 84 extending in laterally (right to left in FIG. 20) of the upper pivoting body 81, a first boom supporting section 85 secured to this first twisting shaft 84, a first boom 86, serving as a first working side pivoting member, pivotably connected to this first boom supporting section 85, a first arm 87, serving as a first operating side pivoting member, pivotably connected to this first boom 86, and a first bucket 88, serving as a first working side pivoting member, pivotably connected to this first arm 87.

The second working device 89 has the same configuration as the first working device 83, and comprises a second twisting shaft 90, a second boom supporting section 91, a second boom 92, a second arm 93 and a second bucket 94. A boom cylinder 7, an arm cylinder 8, a bucket cylinder 9, a boom sensor 56, an arm sensor 57 and a bucket sensor 58 are provided in each of the first and the second working devices 83 and 89, as in the foregoing third embodiment. The upper pivoting body 82 is pivotable relative to the lower propulsion unit 81 by the pivoting motor 10 as in the third embodiment. The right and left twisting shafts 84 and 90 are pivotable by the twisting hydraulic motor 103 as in the fifth embodiment. The first and the second working devices 83 and 89 are pivotable integrally with the twisting shaft 84, respectively.

Figure 28:
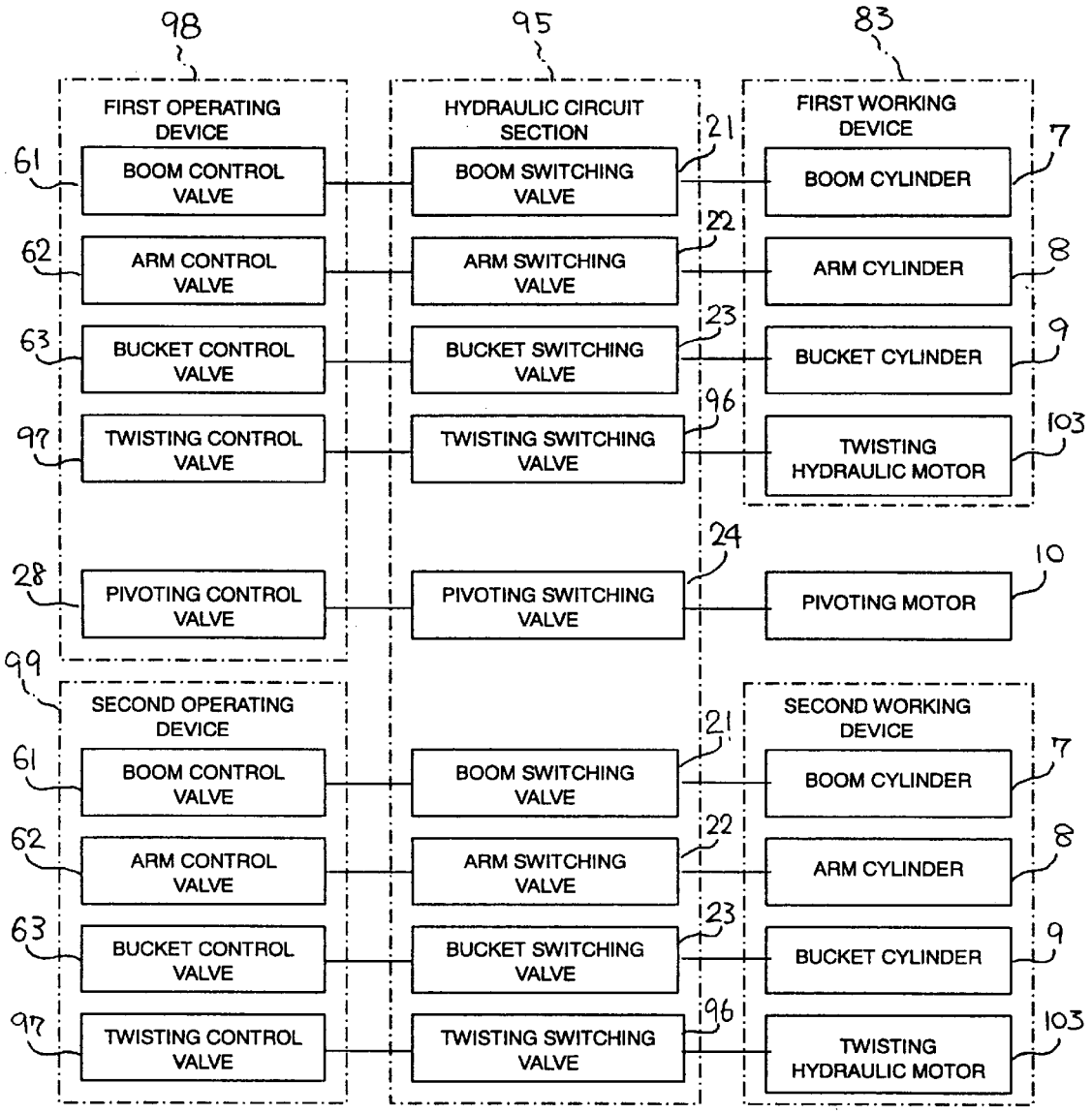
FIG. 28 is a schematic block diagram illustrating an important portion of the hydraulic circuit of the hydraulic excavator shown in FIG. 26.

FIG. 28 is a schematic block diagram illustrating an important portion of the hydraulic circuit of the hydraulic excavator shown in FIG. 26. In FIG. 28, the hydraulic circuit section 95 is provided with two boom switching valves 21, two arm switching valves 22, two bucket switching valves 23, two twisting switching valves 96, and a pivoting switching valve 24. The switching valves 21 to 24 and 96 are controlled by control valves 61 to 63 and 97, respectively.

First and second operating devices 98 and 99 corresponding to the first and second working devices 83 and 89 are provided on the right and left sides of the operating seat in the operator's cab 82A These operating devices 98 and 99 have the same structure as that shown in FIG. 20, and corresponding control valves 61 to 63 and 97 are mounted thereon. The pivoting control valve 28 is mounted only on the first operating device 98.

In this hydraulic excavator as described above, the operator sitting down in the operator's seat operates the right and left operating devices 98 and 99 with his right and left hands, respectively. The operating principle of the first and second working devices 83 and 89 is the same as in the foregoing third and fifth embodiments.

In the present invention, it is possible to operate the boom, the arm and the bucket with the right or left hand, contrary to the conventional practice requiring operation with both hands. With both hands, it is possible to operate two booms, two arms and two buckets. That is, a single operator can easily operate a two-arm hydraulic excavator as shown in the sixth embodiment. This permits efficient achievement of diverse operations.

While the pivoting control valve 24 is provided in the first operating device 98 in the foregoing sixth embodiment, it may be provided in the second operating device 99. A pedal may be provided at the foot of the operator's cab 82A, and the pivoting control valve 24 may be operated by stepping on this pedal.

In addition to these operations, the booms 86 and 92 may swing, i.e., may rotate around an axis extending vertically in FIG. 26.

Further, while the right and the left working devices have the same configurations in the foregoing description, one of the arms may have a different configuration such as an attachment other than a bucket attached to the leading end thereof, for example.

While the working devices 83 and 89 are mounted on the right and left side of the upper pivoting body 82 in the foregoing sixth embodiment, these may also be mounted to the front and back of the pivoting 1 body 82.

In this sixth embodiment, the same transmitting means as in the third and fifth embodiments are used. However, any other transmitting means within the scope of the present invention may also be used, such as the one used in the fourth embodiment.

While the present invention is applied to all the working side pivoting members in the foregoing embodiments, the invention may be applied to only part of the pivoting portions as well.

Further, all the working side pivoting members are brought into operation in conjunction with the operating side pivoting members through similar transmitting means in the foregoing embodiment Different transmitting means may be used for the individual working side pivoting members.

Seventh Embodiment

Figure 29:
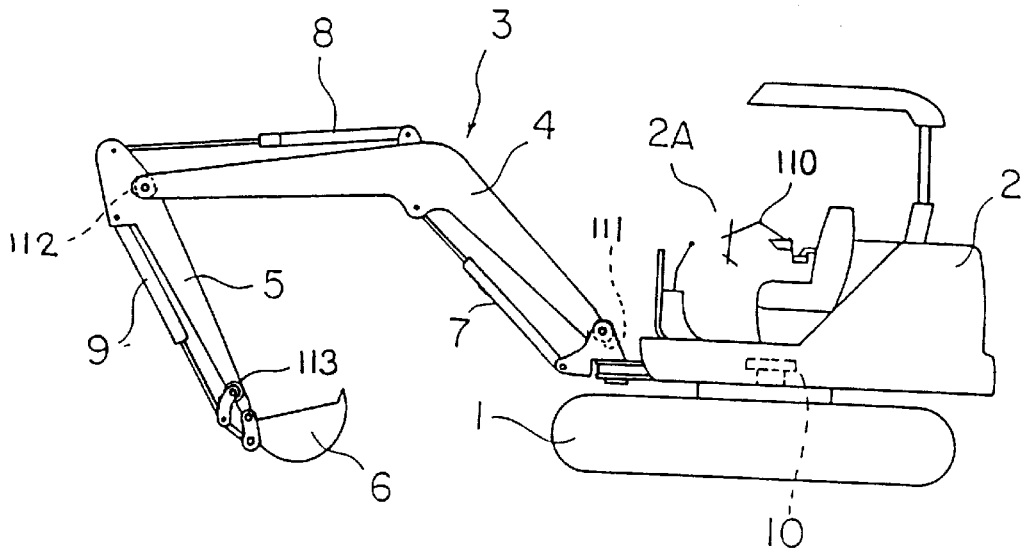
FIG. 29 is a schematic side view illustrating a hydraulic excavator in a seventh embodiment of the invention.

FIG. 29 is a schematic side view illustrating a hydraulic excavator in a seventh embodiment of the invention. In FIG. 29, an operating device 110 forming a link mechanism identical with the link mechanism of the working device, as reduced in size at an appropriate ratio is provided in an operator's cab 2A. A boom sensor 111 serving as a working side sensor detecting pivoting of the boom 4 is provided at the base of the boom 4. At the junction between the boom 4 and an arm 5, there is provided an arm sensor 112, serving as a working side sensor, detecting pivoting of the arm 5. A bucket sensor 112, serving as a working side sensor, detecting pivoting of a bucket 6 is provided in part of the link mechanism for causing the bucket 6 to pivot As these sensors 111 to 113, a known rotation sensor providing an output of an electric signal in response to the status of rotation may be appropriately selected for use. In the present embodiment, a potentiometer using a variable resistor is employed as an example.

Figure 30:
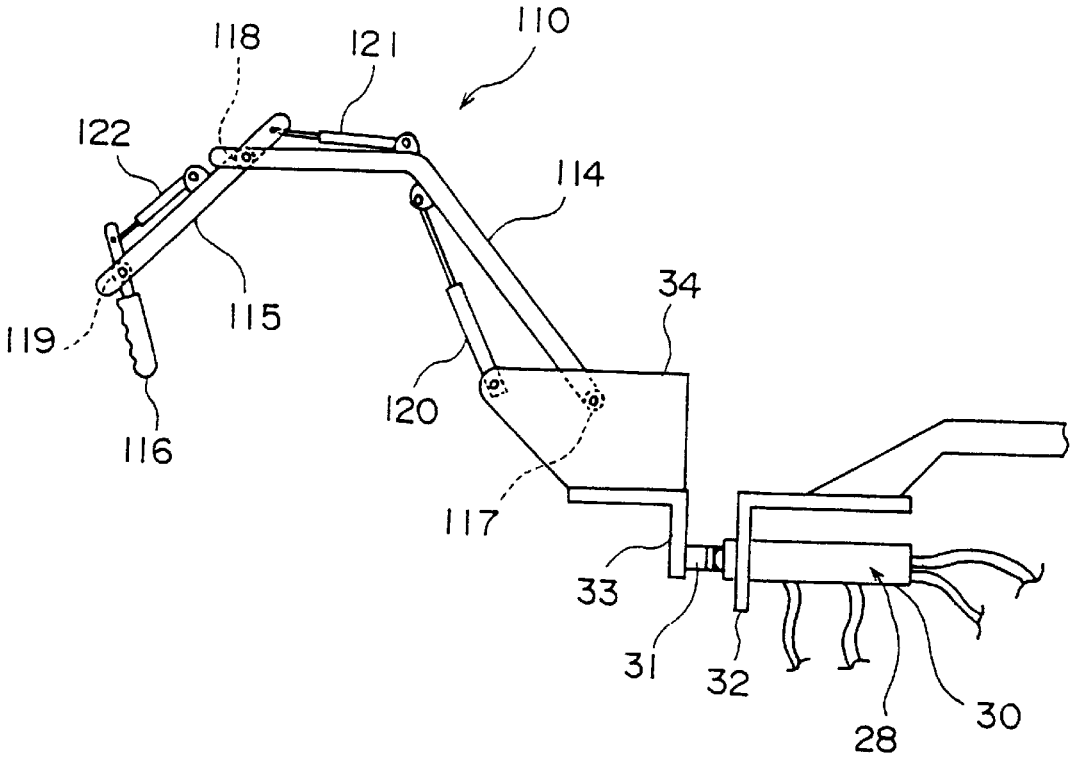
FIG. 30 is an enlarged structural diagram of the operating device shown in FIG. 29.

FIG. 30 is an enlarged structural diagram of the operating device 110 shown in FIG. 29. In FIG. 30, an operating device base 34 is secured onto a movable supporting member 33 as in the foregoing first embodiment. The base of a boom lever 14 serving as an operating side pivoting member is pivotably connected to the operating device base 34. An arm lever 115 serving as an operating side pivoting member is pivotably connected to the leading end of this boom lever 114. Further, a bucket lever 116 serving as an operating side pivoting member is pivotably connected to the leading end of the arm lever 115. The bucket lever 116 also serves as a grip for the operating device 110, and is formed into a shape permitting easy grasping by the operator in the operator's cab 2A. Electric switches and the like for operating incidental equipment may also be mounted on the bucket lever 6.

A boom lever sensor 117, an arm lever sensor 118 and a bucket lever sensor, serving as operating side sensors, detecting pivoting of the individual levers 114 to 116 are provided between the operating device base 34 and the boom lever 114, between the boom lever 114 and the arm lever 115, and between the arm lever 115 and the bucket lever 116, respectively. As the individual lever sensors 117 to 119, ones based on the same principle as that of the working side sensors 111 to 113 are used.

Hydraulic dampers 120 to 122, as means for applying resistance to the operating input of the operator so that the individual levers 114 to 116 do not greatly exceed the followable speed on the working device 3 side are provided between the operating device base 34 and the boom lever 114, between the boom lever 114 and the arm lever 115, and between the arm lever 115 and the bucket lever 116. The resistance provided by these hydraulic dampers 120 to 122 may be adjusted.

Figure 31:
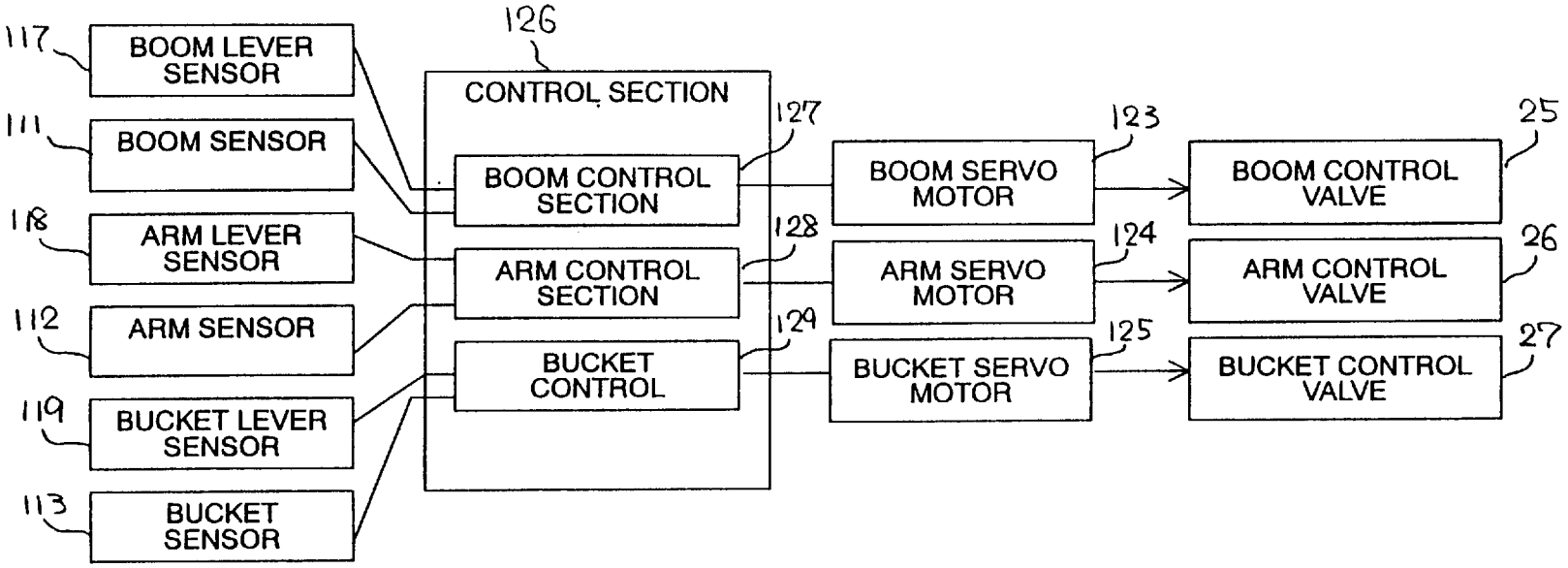
FIG. 31 is a block diagram illustrating the control systems of the individual control valves of the hydraulic excavator shown in FIG. 29.

FIG. 31 is a block diagram illustrating control systems of the individual control valves of the hydraulic excavator shown in FIG. 29. Pivoting is the same as in the foregoing first embodiment, whereas the other control valves 25 to 27 are operated by corresponding servo motors 123 to 125, respectively. The individual servo motors 123 to 125 are controlled by a boom control section 127, an arm control section 128, and a bucket control section 129 in the control section 126, independently of each other. For example, the boom control section 127 has an electric circuit section (not shown) for controlling the servo motor 123 for the boom so as to eliminate the difference between the pivoting information of the boom lever 114 provided as an output from the boom lever sensor 117 and the pivoting information of the boom 4 provided as an output from the boom sensor 111. This is also the case with the arm control section 128 and the bucket control section 129.

Now, the operations will be described below. The operator in the operator's cab 2A holds the bucket lever 116 of the operating device 110, and moves the bucket lever 116 so as to move the bucket 6 while visually watching the bucket 6 and the working site. This causes pivoting of all articulated portions of the operating device 110.

For example, when the boom lever 114 begins pivoting counterclockwise (downward) in FIG. 30, this pivoting is detected by the boom lever sensor 117, and a signal (voltage) corresponding to the state of pivoting is entered into the boom control section 127. Since the boom 4 is still stopped at the moment the boom lever 114 starts pivoting, a signal corresponding to this state of pivoting, i.e., the stoppage, is entered from the boom sensor 111 into the boom control section 127. The boom control section 127 determines the difference between these signals, and issues an instruction signal for eliminating this difference to the boom servo motor 123. This causes driving of the boom servo motor 123, and the boom control valve 25 is operated from the neutral state into one side. The boom 4 is thus caused to pivot in the same direction as the boom lever 114.

When the boom 4 thus pivots, this is detected by the boom sensor 111, and the output value tends to approach the output value from the boom lever sensor 117. However, because this difference is not eliminated so far as the boom lever 114 continues to pivot, the boom control valve 25 continues to be operated on one side, and the boom 4 also continues to pivot When the boom lever 114 is caused to continuously pivot, therefore, the boom 4 follows up this pivoting and continues to pivot. Because the difference between the foregoing output values corresponds to the pivoting speed of the boom lever 114, the boom 4 pivots at substantially the same angular speed as that of the boom lever 114.

When pivoting of the boom lever 114 stops, the difference in output value between the sensors 117 and 111 is eliminated, and the boom servo motor 123 is stopped. At this point, the boom control valve 25 has already been returned to the neutral state, and pivoting of the boom 4 stops. When the boom lever 114 is operated in the reverse direction, the foregoing steps are also in the reverse direction. The arm 5 and the bucket 6 are operated in the same manner as the boom 4. Pivoting operation is the same as in the aforesaid first embodiment.

Since the link mechanism of the working device 3 can be smoothly operated by following along with the link mechanism of the operating device 110, the operator can operate the operating device 110 with a sense of directly operating the working device 3. Since the link mechanism of the operating device 110 automatically follows along through the shortest distance, it is not necessary to worry about the individual angles of the links. It is thus possible to improve operating efficiency without any special skill, and great reductions in total work time can be achieved.

Since the individual pivoting members of the working devices 3 and the operating device 110 are in 1:1 corresponding relationship, it is not necessary to take account of the relative speed or the relative amount of displacement of the arm 5 relative to the movement of the boom 4, for example, and the configuration of the equipment is simple. It is not therefore necessary to perform complicated control at the distributor, and only a single pump need be provided in the hydraulic circuit section, thus permitting large reduction of cost.

Furthermore, hydraulic dampers 120 to 122 are provided to prevent operation of only the operating device 110. It is therefore possible to operate the operating device in synchronization with the working device 3 with only a lightweight and simple construction.

While illustration of wiring between the sensors, control sections and the servo motors is omitted, it is also possible to conduct communication in a wireless manner, thus avoiding troubles caused by disconnection of the lead wires, etc.

In the description of the seventh embodiment, although only a hydraulic excavator mounting one working device 3 was presented, it is needless to say that the structure shown in the seventh embodiment is applicable to the one having a twisting shaft as shown in FIG. 24, or the one mounting two working devices as shown in FIGS. 26 and 27.

Further, while the foregoing embodiments have presented examples of a hydraulic excavator, particularly a hydraulic backhoe, the present invention is applicable to various other hydraulic heavy machines including a track backhoe, a jumbo breaker, a crusher, a clamshell, a hydraulic fork (clamp), and a hydraulic vibroshear. Any of various attachments may be attached in place of the bucket. The invention is also applicable to stationary heavy equipment not having a lower propulsion unit Not limited to construction machinery, the present invention is also applicable to any hydraulic heavy equipment used for any other work.

What is claimed is:

1. Hydraulic heavy equipment comprising:

a heavy equipment body;

a working device having a plurality of working side pivoting members pivotably connected to each other, mounted on said heavy equipment body;

hydraulic cylinders which cause said working side pivoting members pivot;

a hydraulic circuit section for operating said hydraulic cylinders, said hydraulic circuit section having switching valves for switching over the operating direction of said hydraulic cylinders;

an operating device having a plurality of operating side pivoting members which correspond to said working side pivoting members and are pivotably connected to each other;

control valves for controlling said switching valves by being operated by said operating device; and transmitting means for transmitting pivoting of said working side pivoting members and bringing the control valves corresponding to said working side pivoting members back to a neutral state.

2. The hydraulic heavy equipment according to claim 1, wherein said transmitting means has working side transmitting members operating in conjunction with pivoting of the working side pivoting members and operating side transmitting members which operate in conjunction with pivoting of the operating side pivoting members and cause operation of control valves; and when said operating side transmitting members operate under the effect of pivoting of said operating side pivoting members, said control valves are operated, causing operation of said working side pivoting members, this operation of the working side pivoting members causing operation of said operating side pivoting members in a direction to bring said control valves back to the neutral state.

3. The hydraulic heavy equipment according to claim 2, wherein said transmitting means comprises:

a transmitting pulley serving as a working side transmitting member;

an operating side pulley pivoting under the effect of pivoting of the operating side pivoting member;

a operating side cable which is wound between the operating side pulley and said transmitting pulley, a part of said cable being secured to said operating side pulley and said transmitting pulley, respectively; and a displacement member which is reciprocably arranged along the outer periphery of said transmitting pulley, and serves as an operating side transmitting member through which said operating side cable pass; and wherein, upon pivoting of said operating side pivoting members and rotation if said operating side pulley and resulting tensioning of any one side of said operating side cable, said displacement member is moved along the outer periphery of said transmitting pulley, and said control valve is operated; and upon pivoting of said working side pivoting members by operating said control valve, said transmitting pulley causes said displacement member to displace in a direction to bring said control valve back to the neutral state.

4. The hydraulic heavy equipment according to claim 3, wherein said transmitting means has a working side pulley rotating under the effect of pivoting of the working side pivoting members, and a working side cable which is wound between the working side pulley and the transmitting pulley, part of which is secured to said working side pulley and said transmitting pulley, respectively, and transmits rotation of said working side pulley to said transmitting pulley.

5. The hydraulic heavy equipment according to claim 1, wherein the transmitting means comprises a first transmitting pivoting body serving as a working side transmitting member pivoting in conjunction with pivoting of the working side pivoting members, and a second transmitting pivoting body serving as an operating side transmitting member pivoting in conjunction with pivoting of the operating side pivoting members, in a configuration in which a control valve is mounted on any one of said first and the second transmitting pivoting bodies, and said control valve is operated under the effect of the pivoting of the other.

6. The hydraulic heavy equipment according to claim 1, wherein the control valve comprises a first valve piece pivoting upon pivoting of the operating side pivoting members, and a second valve piece pivotably combined with said first valve piece, so that the switching valves are controlled by pivoting of said first valve piece relative to said second valve piece.

7. The hydraulic heavy equipment according to claim 6, wherein said transmitting means comprises a sensor detecting pivoting of the working side pivoting members and a servo motor causing pivoting of the second valve piece in response to a signal from the sensor.

8. The hydraulic heavy equipment according to claim 1, wherein said working side pivoting member comprises a boom connected to the heavy equipment body and pivotable in a direction allowing vertical movement of the leading end around the boom axis, and an arm connected to this boom and pivotable around the arm axis parallel to said boom axis; and said boom being pivotable around a twisting axis extending in a direction at right angles to said boom axis in a plane parallel with the plane on which the heavy equipment body is placed.

9. The hydraulic heavy equipment according to claim 1, wherein two working devices and two operating devices corresponding thereto are mounted on the heavy equipment body.

10. The hydraulic heavy equipment according to claim 1, comprising:

a lower propulsion unit;

an upper pivoting body mounted pivotably on said lower propulsion unit, on which the working devices and the operating devices are mounted; and a pivoting motor causing pivoting of said upper pivoting body;

wherein a switching valve for switching over the operating direction of said pivoting motor is provided in the hydraulic circuit section; a pivoting control valve for said pivoting motor is secured to a securing member supporting the operating device; said pivoting control valve is operated by causing said operating device to pivot in the pivoting direction of said upper pivoting body to bring said pivoting control valve back to the neutral state.

11. Hydraulic heavy equipment comprising:

a heavy equipment body;

a working device having a plurality of working side pivoting members pivotably connected to each other, and mounted on said heavy equipment body;

hydraulic cylinders causing said working side pivoting members;

a hydraulic circuit section for operating said hydraulic cylinders, said hydraulic circuit section having switching valves for switching over the operating direction of said hydraulic cylinders;

an operating device having a plurality of operating side pivoting members which correspond to said working side pivoting members and are pivotably connected to each other;

control valves for controlling said switching valves;

servo motors for operating said control valves;

operating side sensors for detecting pivoting of said operating side pivoting members;

working side sensors for detecting pivoting of said working side pivoting members; and a control section which receives input of a signal from said operating side sensors and said working side sensors, and controls said servo motors so as to ensure operation of said working side pivoting members in a manner similar to that of said operating side pivoting members.

12. The hydraulic heavy equipment according to claim 11, wherein there is provided resistance means for imparting a restriction on the operating speed of the operating side pivoting members.

13. The hydraulic heavy equipment according to claim 11, wherein the control section has an electric circuit section controlling said servo motor so as to eliminate a difference between an output from said operating side sensor and an output from said working side sensor.

14. The hydraulic heavy equipment according to claim 11, wherein the working side pivoting member has a boom connected to the heavy equipment body, and pivotable in a direction allowing vertical movement of a leading end around a boom axis, and an arm connected to this boom and pivotable around an arm axis parallel to said boom axis; and said boom is pivotable around a twisting axis extending in a direction at right angles to said boom axis in a plane parallel to a plane in which the heavy equipment body is placed.

15. The hydraulic heavy equipment according to claim 11, wherein two working devices and two operating devices corresponding thereto are mounted on the heavy equipment body.

16. The hydraulic heavy equipment according to claim 15, wherein the heavy equipment body comprises a lower propulsion unit and an upper pivoting body mounted pivotably on said lower propulsion unit, and pivoting of said upper pivoting body is controlled by a pedal provided on said upper pivoting body.

17. The hydraulic heavy equipment according to claim 11, comprising:

a lower propulsion unit;

an upper pivoting body mounted pivotably on said lower propulsion unit, on which the working devices and the operating devices are mounted; and a pivoting motor causing pivoting of said upper pivoting body;

wherein a switching valve for switching over the operating direction of said pivoting motor is provided in the hydraulic circuit section; a pivoting control valve for said pivoting motor is secured to a securing member supporting the operating device; said pivoting control valve is operated by causing said operating device to pivot in the pivoting direction of said upper pivoting body to bring said pivoting control valve back to the neutral state.

* * * * *